US007788098B2

(12) United States Patent
Feng et al.

(10) Patent No.: US 7,788,098 B2
(45) Date of Patent: Aug. 31, 2010

(54) PREDICTING TONE PATTERN INFORMATION FOR TEXTUAL INFORMATION USED IN TELECOMMUNICATION SYSTEMS

(75) Inventors: Ding Feng, Beijing (CN); Yang Cao, Beijing (CN)

(73) Assignee: Nokia Corporation, Espoo (FI)

( * ) Notice: Subject to any disclaimer, the term of this patent is extended or adjusted under 35 U.S.C. 154(b) by 1466 days.

(21) Appl. No.: 10/909,462

(22) Filed: Aug. 2, 2004

(65) Prior Publication Data

US 2006/0025999 A1 Feb. 2, 2006

(51) Int. Cl.
*G10L 13/08* (2006.01)
*G10L 13/00* (2006.01)

(52) U.S. Cl. ..... 704/260; 704/258

(58) Field of Classification Search ..... 704/258, 704/260, 267
See application file for complete search history.

(56) References Cited

U.S. PATENT DOCUMENTS

| | | | | |
|---|---|---|---|---|
| 5,652,828 | A * | 7/1997 | Silverman | 704/260 |
| 5,905,972 | A * | 5/1999 | Huang et al. | 704/268 |
| 6,516,298 | B1 * | 2/2003 | Kamai et al. | 704/260 |
| 7,002,491 | B2 * | 2/2006 | Robbins | 341/28 |
| 7,136,816 | B1 * | 11/2006 | Strom | 704/260 |
| 2002/0099547 | A1 * | 7/2002 | Chu et al. | 704/260 |
| 2002/0152067 | A1 * | 10/2002 | Viikki et al. | 704/231 |
| 2004/0006458 | A1 * | 1/2004 | Fux et al. | 704/8 |

FOREIGN PATENT DOCUMENTS

| | | | |
|---|---|---|---|
| EP | 1085401 | A1 * | 3/2001 |
| EP | 0 833 304 | B1 | 3/2003 |
| WO | WO 03/065349 | | 8/2003 |

OTHER PUBLICATIONS

Cao et al, "Decision Tree Based Mandarin Tone Model and its application to speech Recognition" 2000, IEEE, p. 1759-1762.*

Shih et al, "Issues in Text-to-Speech Conversion for Mandarin", Aug. 1996, Computational Linguistics and Chinese Language Processing, vol. 1, No. 1, pp. 37-86.*

Lee at al, "The synthesis Rules in a Chinese Text-to-Speech System", Sep. 1989, IEEE transactions on Acoustics, Speech and Signal Proceessing, vol. 37, No. 9, pp. 1309-1320.*

Yang Cao, et al., "Decision Tree Based Mandarin Tone Model and Its Application to Speech Recognition," National Laboratory of Pattern Recognition Institute of Automation, Chinese Academy of Sciences, pp. 1759-1762, © 2000 IEEE, Beijing, P. R. China.

(Continued)

*Primary Examiner*—Richemond Dorvil
*Assistant Examiner*—Olujimi A Adesanya
(74) *Attorney, Agent, or Firm*—Foley & Lardner LLP

(57) ABSTRACT

The techniques described include generating tonal information from a textual entry and, further, applying this tonal information to PINYIN sequences using decision trees. For example, a method of predicting tone pattern information for textual information used in telecommunication systems includes parsing a textual entry into segments and identifying tonal information for the textual entry using the parsed segments. The tonal information can be generated with a decision tree. The method can also be implemented in a distributed system where the conversion is done at a back-end server and the information is sent to a communication device after a request.

13 Claims, 3 Drawing Sheets

OTHER PUBLICATIONS

Pui-Fung Wong, et al., "Decision Tree Based Tone Modeling for Chinese Speech Recognition," Hong Kong University of Science and Technology, pp. I-905-I-908, © 2004 IEEE, Hong Kong.

Janne Suontausta et al., "Low Memory Decision Tree Method for Text-to Phoneme Mapping," Nokia Research Center, Audio-Visual Systems Laboratory, pp. 135-140, © 2003 IEEE, Tampere, Finland.

Xia Wang, et al., "An Embedded Multilingual Speech Recognition System for Mandarin, Cantonese and English," Nokia Research Center, Audio-Visual Systems Laboratory, pp. 758-764, © 2003 IEEE, Beijing, P. R. China.

* cited by examiner

```
((tone 0 1 2 3 4)
(n::final)
(t::initial)
(t::final)
(n::initial))
```

PREDICTING TONE PATTERN INFORMATION FOR TEXTUAL INFORMATION USED IN TELECOMMUNICATION SYSTEMS

BACKGROUND OF THE INVENTION

1. Field of the Invention

The present invention relates generally to speech recognition and text-to-speech (TTS) synthesis technology in telecommunication systems. More particularly, the present invention relates to predicting tone pattern information for textual information used in telecommunication systems.

2. Description of the Related Art

This section is intended to provide a background or context to the invention that is recited in the claims. The description herein may include concepts that could be pursued, but are not necessarily ones that have been previously conceived or pursued. Therefore, unless otherwise indicated herein, what is described in this section is not prior art to the claims in this application and is not admitted to be prior art by inclusion in this section.

Voice can be used for input and output with mobile communication terminals. For example, speech recognition and text-to-speech (TTS) synthesis technology utilize voice for input and output with mobile terminals. Such technologies are particularly useful for disabled persons or when the mobile terminal user cannot easily use his or her hands. These technologies can also give vocal feedback such that the user does not have to look at the device.

Tone is crucial for Chinese (e.g., Mandarin, Cantonese, and other dialects) and other languages. Tone is mainly characterized by the shape of its fundamental frequency (F0) contour. For example, as illustrated in FIG. 1, Mandarin tones 1, 2, 3, and 4 can be described as: high level, high-rising, low-dipping and high-falling, respectively. The neutral tone (tone 0) does not has specific F0 contour, and is highly dependent on the preceding tone and usually perceived to be temporally short.

Text-to-speech in tonal languages like Chinese are challenging because usually there is no tonal information available in the textual representation. Still, tonal information is crucial for understanding. Tone combinations of neighboring syllables can form certain tone patterns. Further, tone can significantly affect speech perception. For example, tone information is crucial to Chinese speech output. In English, an incorrect inflection of a sentence can render the sentence difficult to understand. In Chinese, an incorrect intonation of a single word can completely change it's meaning.

In many cases, tone information of syllables is not available. For example, Chinese phone users can have names in a phone directory ("contact names") in PINYIN format. PINYIN is a system for transliterating Chinese ideograms into the Roman alphabet, officially adopted by the People's Republic of China in 1979. The PINYIN format used for the contact name may not include tonal information. It can be impossible to get tone information directly from the contact name itself. Without tone or with the incorrect tone, generated speech from text is in poor quality and can completely change the meaning of the text.

U.S. patent application 2002/0152067, which is assigned to the same assignee as the present application, discloses a method where the pronunciation model for a name or a word can be obtained from a server residing in the network. However, this patent application only describes a solution involving pronunciation. Use of tonal information is not included or suggested. As indicated above, significant meanings can be lost without tonal information.

International patent application WO 3065349 discloses adding tonal information to text-to-speech generation to improve understandability of the speech. The technique described by this patent application utilizes an analysis of the context of the sentence. Tone is identified based on the context of other in which the word is located. However, such context is not always available, particularly with communication systems such as mobile phones, nor does context always provide the clues needed to generate tonal information.

Thus, there is a need to predict tone patterns for a sequence of syllables without depending on the context. Further, there is a need to predict tone patterns to properly identify names used as contacts for a mobile device. Even further, there is a need to synthesize contact names in communication terminals when tone information is not available. Still further, there is a need to generate tonal information from text for languages like Chinese where tonal information is vital for communication and comprehension.

SUMMARY OF THE INVENTION

In general, the invention relates to generating tonal information from a textual entry and, further, applying this tonal information to PINYIN sequences using decision trees. At least one exemplary embodiment relates to a method of predicting tone pattern information for textual information used in computer systems. The method includes parsing a textual entry into segments and identifying tonal information for the textual entry using the parsed segments. The tonal information can be generated with a decision tree. The method can also be implemented in a distributed system where the conversion is done at a back-end server and the information is sent to a communication device after a request.

Another exemplary embodiment relates to a device that predicts tone pattern information for textual information based on the textual information and not the context of the textual information. The device includes a processing module and a memory. The processing module executes programmed instructions and the memory contains programmed instructions to parse a textual entry into segments and identify tonal information for the textual entry using the parsed segments.

Another exemplary embodiment relates to a system that predicts tone pattern information for textual information based on the textual information and not the context of the textual information. The system includes a terminal equipment device having one or more textual entries stored thereon and a processing module that parses textual entries into segments and identifies tonal information for the textual entries using the parsed segments.

Another exemplary embodiment relates to a computer program product having computer code that parses a textual entry into segments and identifies tonal information for the textual entry using the parsed segments.

DETAILED DESCRIPTION OF EXEMPLARY EMBODIMENTS

Figure 2:
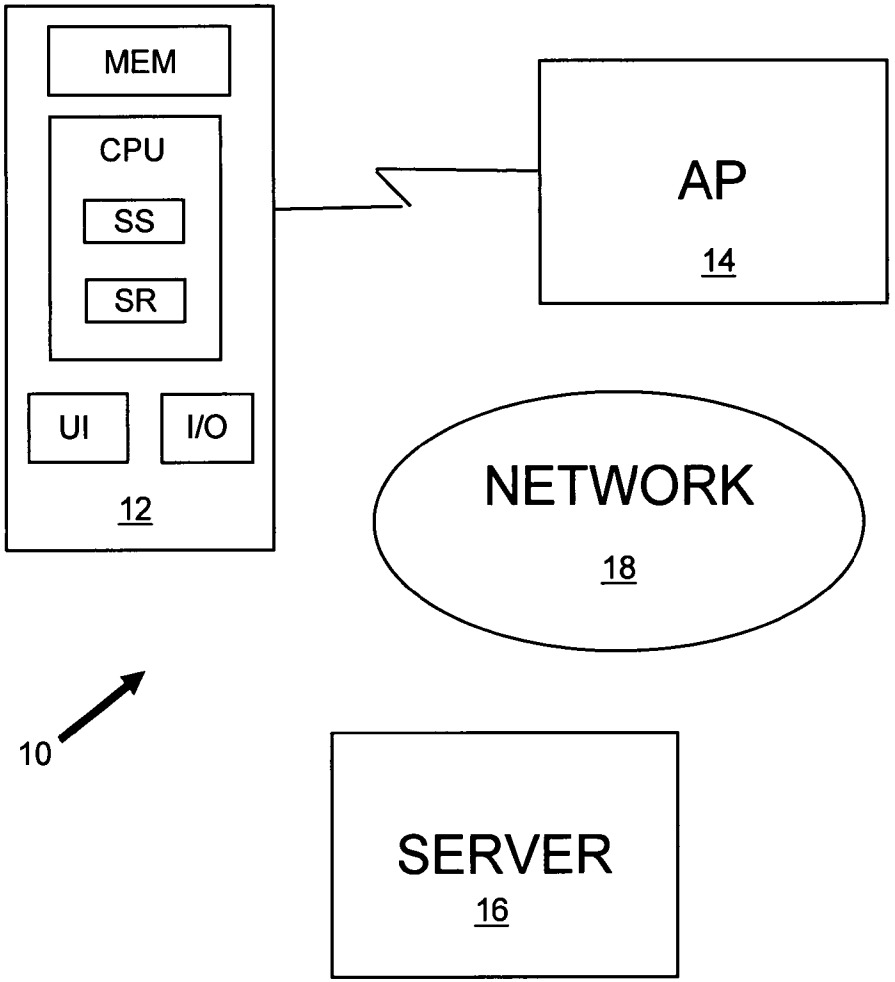
FIG. 2 is a general block diagram depicting a tone estimation system in accordance with an exemplary embodiment.
Figure 1:
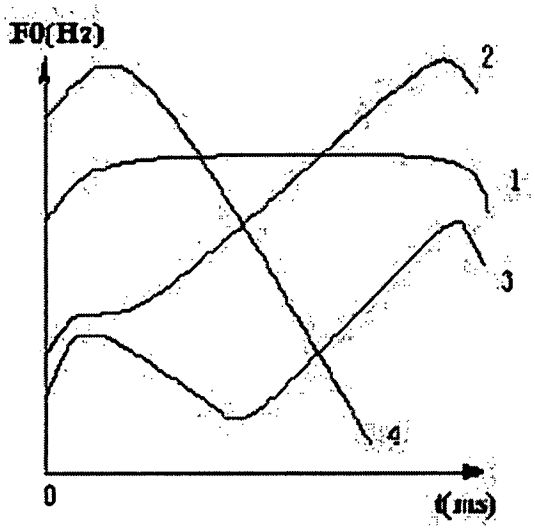
FIG. 1 is a graph of fundamental frequency contours for various Mandarin Chinese tones.

FIG. 2 illustrates a communication system 10 including devices configured with tone estimation capabilities in accordance with an exemplary embodiment. The exemplary embodiments described herein can be applied to any telecommunications system including an electronic device with a speech synthesis application and/or a speech recognition application, and a server, between which data can be transmitted.

Communication system 10 includes a terminal equipment (TE) device 12, an access point (AP) 14, a server 16, and a network 18. The TE device 12 can include memory (MEM), a central processing unit (CPU), a user interface (UI), and an input-output interface (I/O). The memory can include non-volatile memory for storing applications that control the CPU and random access memory for data processing. A speech synthesis (SS) module, such as a text-to-speech (TTS) module, can be implemented by executing in the CPU programmed instructions stored in the memory. A speech recognition (SR) module can be implemented by executing in the CPU programmed instructions stored in the memory. The I/O interface can include a network interface card of a wireless local area network, such as one of the cards based on the IEEE 802.11 standards.

The TE device 12 can be connected to the network 18 (e.g., a local area network (LAN), the Internet, a phone network) via the access point 14 and further to the server 16. The TE device 12 can also communicate directly with the server 16, for instance using a cable, infrared, or a data transmission at radio frequencies. The server 16 can provide various processing functions for the TE device 12. The server 16 can provide back-end processing services for the TE device 12.

The TE device 12 can be any portable electronic device, in which speech recognition or speech synthesis is performed, for example a personal digital assistant (PDA) device, remote controller or a combination of an earpiece and a microphone. The TE device 12 can be a supplementary device used by a computer or a mobile station, in which case the data transmission to the server 16 can be arranged via a computer or a mobile station. In an exemplary embodiment, the TE device 12 is a mobile station communicating with a public land mobile network, to which also the server S is functionally connected. The TE device 12 connected to the network 18 includes mobile station functionality for communicating with the network 18 wirelessly. The network 18 can be any known wireless network, for instance a network supporting the GSM service, a network supporting the GPRS (General Packet Radio Service), or a third generation mobile network, such the UMTS (Universal Mobile Telecommunications System) network according to the 3GPP ($3^{rd}$ Generation Partnership Project) standard. The functionality of the server 16 can also be implemented in the mobile network. The TE device 16 can be a mobile phone used for speaking only, or it can also contain PDA (Personal Digital Assistant) functionality.

The TE device 12 can utilize tone pattern information, which is used to decide tone of no-tone PINYIN sequence, or other sequences that do not have tonal information but where tonal information is important. The TE device 12 can acquire such information via the network 18, or can be acquired offline before it is used. Tone patterns can be captured from a database, and then saved in a certain model as pre-knowledge. The model could be a classification and regression tree (CART) tree or neural network and other structure. In an alternative embodiment, the server 16 estimates tonal information and communicates the tonal information attached to the text to the TE device 12.

Figure 3:
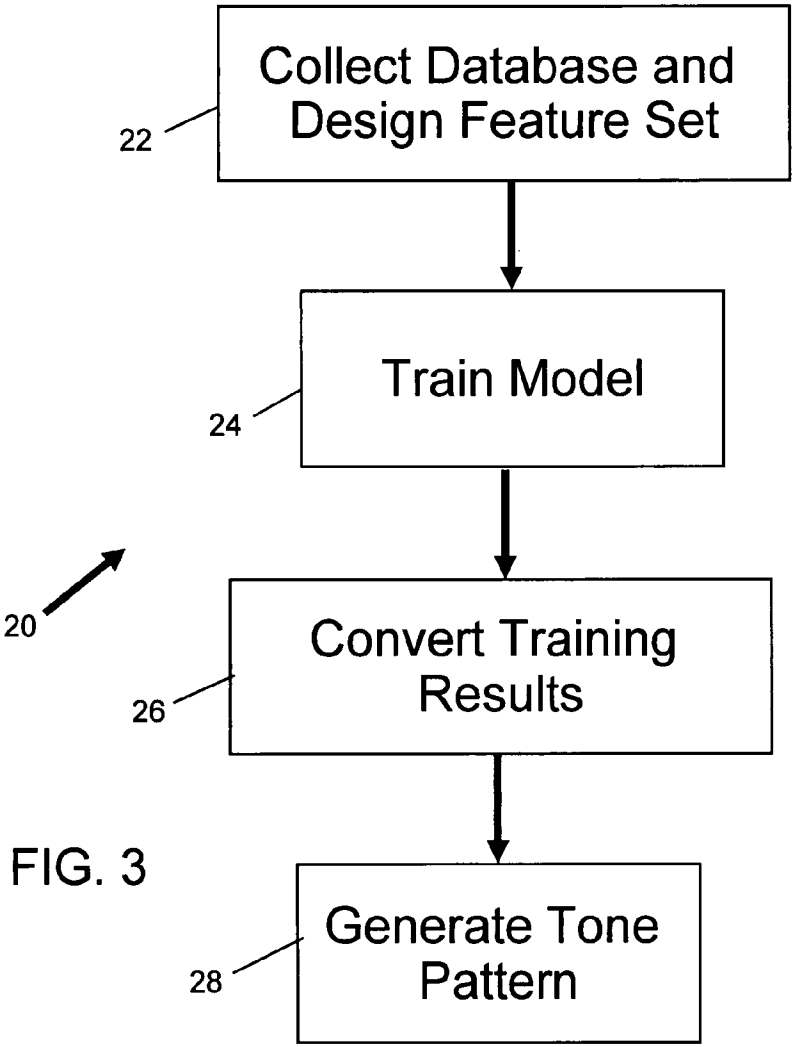
FIG. 3 is a flow diagram depicting exemplary operations performed in a process of classifying tone information.

FIG. 3 illustrates a flow diagram 20 of exemplary operations performed in a process of classifying tone information. Additional, fewer, or different operations may be performed, depending on the embodiment. In an exemplary embodiment, a classification and regression tree (CART) is used. CART can be used for predicting continuous dependent variables (regression) and categorical predictor variables (classification).

In an operation 22, a database and design feature set is collected. Preferably, the database contains main features of tone pattern in application domain. For example, to collect database for Chinese name feedback, the name list should be large enough, all Chinese surname and frequently used given names should be included. Different length names should be also taken into consideration. Based on a feature set, all feature are calculated for each entry in database.

Figures 4, 5:
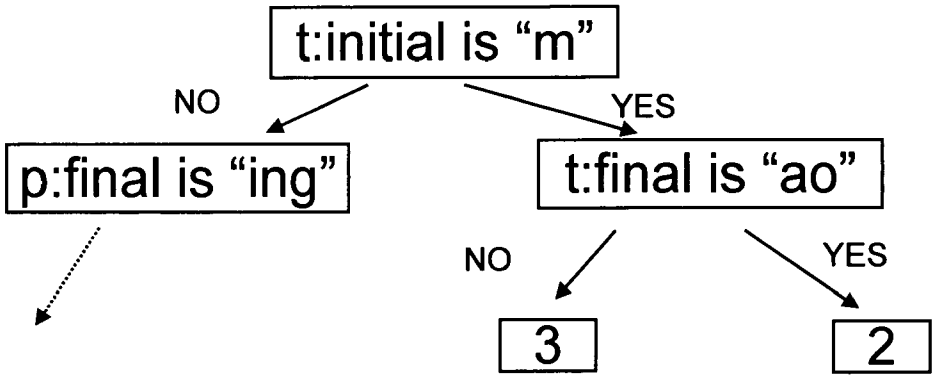
FIG. 4 is a diagram depicting an example feature set used in the tone estimation system of FIG. 2.
FIG. 5 is a diagram depicting an example classification and regression tree (CART) having training results in accordance with an exemplary embodiment.

FIG. 4 illustrates an exemplary feature set 30, which is depicted as ((tone 0 1 2 3 4) (n::final) (t::initial) (t:final) (n::initial)). The values "p", "t" and "n" refer to previous syllable, current syllable and next syllable, respectively. Tone 0 1 2 3 4 refers to various different tones. The feature set 30 can be stored in a memory on a communication terminal.

Referring again to FIG. 3, in an operation 24, the model is trained using a training algorithm. The training algorithm is used to extract essential tone pattern information into a training database. The training process is complete when a specified criterion is satisfied, such as maximum entropy.

A decision tree such as the CART structure 40 can be used to generate suitable tones for a sequence of input syllables. The decision tree is trained on an tagged database. A decision tree is composed of nodes that are linked together as illustrated in FIG. 5. An attribute is attached to each node. The attribute specifies what kind of context information is considered in the node. The context information may include the syllables on the left and right hand side of the current syllable. Some smaller units, such as INITIAL/FINAL can be used. In addition, the previous INITIAL/FINAL syllables and their classes may be used. Each node of the tree is followed by child nodes, unless the node is a leaf.

Movement from a node to a child node is based on the values of the attribute specified in the node. When the decision tree is used for retrieving the tone that corresponds to the syllable in a certain context, the search starts at the root node. The tree is climbed until a leaf is found. The tone that corresponds to the syllable in the given context is stored in the leaf.

When a decision tree is trained from a tagged database, all the training cases are considered. A training case is composed of the syllable and tone context and the corresponding tone in the tagged database. During training, the decision tree is grown and the nodes of the decision tree are split into child nodes according to an information theoretic optimization criterion. The splitting continues until the optimization criterion cannot be further improved.

In training, the root node of the tree is split first. In order to split the node into child nodes, an attribute has to be chosen. All the different attributes are tested and the one that maximizes the optimization criterion is chosen. Information gain is used as the optimization criterion. In order to compute the information gain of a split, the tone distribution before splitting the root node has to be known. Based on the tone distribution in the root node, the entropy E is computed according to:

$$E = -\sum_{i=1}^{N} f_i \log_2 f_i$$

where $f_i$ is the relative frequency of occurrence for the $i^{th}$ tone, and N is the number of tones. Based on the syllable and tone contexts, the training cases in the root node are split into subsets according to the possible attributes. For an attribute, the entropy after the split, $E^S$, is computed as the average entropy of the entropies of the subsets. If $E_j^S$ denotes the entropy of the subset j after the split, the average entropy after the split is:

$$E^S = -\sum_{j=1}^{K} \frac{|S_j|}{|S|} E_j^S$$

where |S| is the total number of training cases in the root node, $|S_j|$ is the number of training cases in the $j^{th}$ subset, and K is the number of subsets. The information gain for an attribute is given by:

$$G=E-E^S$$

The information gain is computed for each attribute, and the attribute that has the highest information gain is selected. The splitting of the nodes in the tree is repeated for the child nodes. The training cases belonging to each child node are further split into subsets according to the different attributes. For each child node, the attribute that has the highest information gain is selected. The splitting of the nodes in the tree continues while the information gain is greater than zero and the entropies of the nodes can be improved by splitting. In addition to the information gain, the splitting is controlled by a second condition. A node can be split only if there are at least two child nodes that will have at least a preset minimum number of training cases after the split. If the information gain is zero or the second condition is not met, the node is not split.

FIG. 5 illustrates a CART structure 40 depicting an example of training results. The CART structure 40 shows relationships between nodes in a tone estimation model. If the current syllable begins with "m" and ends with "ao," tone 2 is identified. If the current syllable begins with "m: and does not end with "ao," tone 3 is identified.

Referring again to FIG. 3, in an operation 26, the training results are converted to a compressed format to save memory space and accelerate the usage procedure. The tone pattern information is stored in training results. In an operation 28, the tone pattern is generated. When a syllable sequence is coming, all syllables can be used to switch between tree branches, and go through tree from top until a leaf is reached.

Referring now to FIG. 5, for example, if the CART structure 40 is used and a coming PINYIN string is "mao ze dong", for the first syllable "mao", its initial is "m", according to the top node, switch to right branch, then according to the second level node, its final is "ao", switch to right branch again and reach the leaf node, so tone for "mao" will be set as "2".

Figure 6:
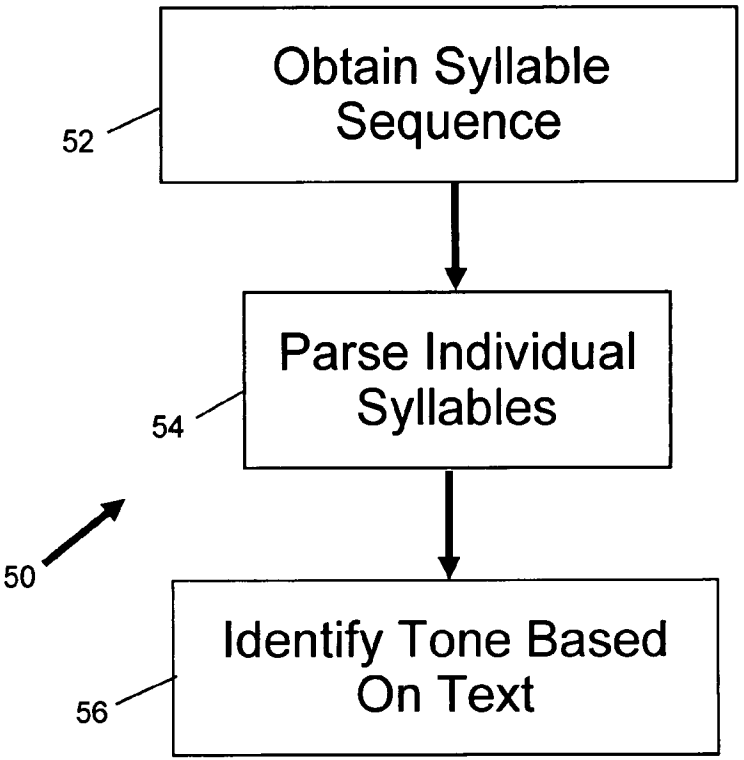
FIG. 6 is a flow diagram depicting exemplary operations performed in a tone estimation process.

FIG. 6 illustrates a flow diagram 50 of exemplary operations performed in a tone estimation process. Additional, fewer, or different operations may be performed, depending on the embodiment. In an operation 52, a processing unit in a terminal equipment (TE) device obtains a syllable sequence. The syllable sequence can be one or more words. The processing unit can obtain the syllable sequence from memory. In general, the processing unit operates based on programmed instructions also contained in memory.

In an operation 54, the processing unit parses the individual syllables. Tone information is obtained or estimated based on the parsed text in an operation 56. For example, tone pattern information contained in a feature set can provide information from which the processing unit identifies corresponding tones. The feature set can be embodied in a CART structure such as CART structure 40 described with reference to FIG. 4.

While several embodiments of the invention have been described, it is to be understood that modifications and changes will occur to those skilled in the art to which the invention pertains. For example, although Chinese is used as an example language requiring tonal information, the system is not limited to operation with a particular language. Accordingly, the claims appended to this specification are intended to define the invention precisely.

The invention claimed is:

1. A method of predicting tone pattern information for textual information used in computer systems, the method comprising:

using a device to:

parse a textual entry into parsed segments;

identify tonal information for the textual entry using the parsed segments, wherein the device is configured to identify the tonal information for the textual entry using the parsed segments by locating corresponding tonal information for a first parsed segment in a classification tree, and wherein the locating of the corresponding tonal information for the first parsed segment in a classification tree comprises:

identifying a first alphabet of the first parsed segment;

analyzing the first alphabet of the first parsed segment;

determining, based on the analysis of the first alphabet, a branch within the classification tree for a subsequent analysis operation, wherein the branch is associated with a previous parsed segment of the first parsed segment or a next parsed segment of the first parsed segment;

analyzing, at the branch, the previous parsed segment of the first parsed segment or the next parsed segment of the first parsed segment; and setting a tone for the first parsed segment based on the analysis of the previous parsed segment of the first parsed segment or the next parsed segment of the first parsed segment.

2. The method of claim 1, wherein the textual entry includes PINYIN sequences.

3. The method of claim 1, wherein identifying tonal information for the textual entry using the parsed segments comprises accessing a database containing tonal information for the textual entry based on the parsed segments.

4. The method of claim 1, wherein the device is further configured to communicate identified tonal information from a back-end server to a communication device.

5. The method of claim 1, wherein the textual entry is a name in a contact list on a communication device.

6. An apparatus comprising:

at least one processor; and at least one memory including computer program code, the at least one memory and the computer program code configured to, with the at least one processor, cause the apparatus to perform at least the following:

parse a textual entry into parsed segments;

identify tonal information for the textual entry using the parsed segments, wherein the apparatus is caused to identify the tonal information for the textual entry using the parsed segments by locating corresponding tonal information for a first parsed segment in a classification tree, and wherein the locating of the corresponding tonal information for the first parsed segment in a classification tree comprises:

identifying a first alphabet of the first parsed segment;

analyzing the first alphabet of the first parsed segment;

determining, based on the analysis of the first alphabet, a branch within the classification tree for a subsequent analysis operation, wherein the branch is associated with a previous parsed segment of the first parsed segment or a next parsed segment of the first parsed segment;

analyzing, at the branch, the previous parsed segment of the first parsed segment or the next parsed segment of the first parsed segment; and setting a tone for the first parsed segment based on the analysis of the previous parsed segment of the first parsed segment or the next parsed segment of the first parsed segment.

7. The apparatus of claim 6, wherein the tonal information is stored in a database accessed by a server.

8. The apparatus of claim 6, wherein the textual entry includes PINYIN sequences.

9. The apparatus of claim 6, wherein the textual entry includes a name from a contact list.

10. A system that predicts tone pattern information for textual information based on the textual information, the system comprising:

a terminal equipment device having one or more textual entries stored thereon; and a processing module that parses the one or more textual entries into segments and identifies tonal information for the one or more textual entries using the parsed segments, wherein the processing module is contained within the terminal equipment device;

the processing module further configured to:

locate corresponding tonal information for a first parsed segment in a classification tree;

identify a first alphabet of the first parsed segment;

analyze the first alphabet of the first parsed segment;

determine, based on the analysis of the first alphabet, a branch within the classification tree for a subsequent analysis operation, wherein the branch is associated with a previous parsed segment of the first parsed segment or a next parsed segment of the first parsed segment;

analyze, at the branch, the previous parsed segment of the first parsed segment or the next parsed segment of the first parsed segment; and set a tone for the first parsed segment based on the analysis of the previous parsed segment of the first parsed segment or the next parsed segment of the first parsed segment.

11. The system of claim 10, further comprising a contact list of names, the names including PINYIN sequences.

12. A computer program product embodied on a memory comprising programmed instructions that when executed cause a device to perform operations comprising:

parsing a textual entry into segments and identify tonal information for the parsed segments, wherein the tonal information is generated for a first parsed segment using a decision tree;

identifying a first alphabet of the first parsed segment;

analyzing the first alphabet of the first parsed segment;

determining, based on the analysis of the first alphabet, a branch within the classification tree for a subsequent analysis operation, wherein the branch is associated with a previous parsed segment of the first parsed segment or a next parsed segment of the first parsed segment;

analyzing, at the branch, the previous parsed segment of the first parsed segment a or the next parsed segment of the first parsed segment; and setting a tone for the first parsed segment based on the analysis of the previous parsed segment of the first parsed segment or the next parsed segment of the first parsed segment.

13. The computer program product of claim 12, wherein the tonal information is attached to the textual entry after identification.

* * * * *